United States Patent [19]

Schollmeier et al.

[11] 4,159,524

[45] Jun. 26, 1979

[54] CIRCUIT ARRANGEMENT FOR THE SUMMATION OF PRODUCTS FORMED BY ANALOG SIGNALS AND DIGITAL COEFFICIENTS

[75] Inventors: Gero Schollmeier, Gauting; Heinrich Sailer; Helmut Koeth, both of Munich, all of Fed. Rep. of Germany

[73] Assignee: Siemens Aktiengesellschaft, Berlin & Munich, Fed. Rep. of Germany

[21] Appl. No.: 858,160

[22] Filed: Dec. 7, 1977

[30] Foreign Application Priority Data

Jan. 28, 1977 [DE] Fed. Rep. of Germany ..... 2703649

[51] Int. Cl.[2] ..... G06J 1/00

[52] U.S. Cl. ..... 364/606; 364/602; 364/724

[58] Field of Search ..... 364/606, 607, 602, 605, 364/724, 825

[56] References Cited

U.S. PATENT DOCUMENTS

| | | | |
|---|---|---|---|
| 3,171,022 | 2/1965 | Schmid | 364/606 |
| 3,480,767 | 11/1969 | Howe | 364/608 |
| 3,513,301 | 5/1970 | Howe | 364/608 |
| 3,558,863 | 1/1971 | Williams, Jr. et al. | 364/606 X |
| 4,000,401 | 12/1976 | Quinn, Jr. | 364/607 |

FOREIGN PATENT DOCUMENTS 1157677 11/1963 Fed. Rep. of Germany.

OTHER PUBLICATIONS

Instruments & Automation, Jun. 1958, pp. 1063–1067.
Instruments & Automation, Oct. 1956, pp. 2019–2023.
Diamantides—"A Multipurpose Electronic Switch for Analog Computer Simulation and Autocorrelation Applications"—IRE Transactions on Electronic Computers, Dec. 1956, pp. 197–202.

*Primary Examiner*—Joseph F. Ruggiero
*Attorney, Agent, or Firm*—Hill, Van Santen, Steadman, Chiara & Simpson

[57] ABSTRACT

A circuit arrangement is disclosed for the summation of products formed from analog signals and digital coefficients. A multiplying digital-analog converter is provided having a reference input for receiving analog signals at successive points in time. A data input of the digital-analog converter receives digital coefficients assigned to the respective analog signals. A summation stage connected to output signals of the digital-analog converter integrates over a predetermined time period the output signals of the digital-analog converter representative of products of the analog signals and digital coefficients.

8 Claims, 3 Drawing Figures

CIRCUIT ARRANGEMENT FOR THE SUMMATION OF PRODUCTS FORMED BY ANALOG SIGNALS AND DIGITAL COEFFICIENTS

BACKGROUND OF THE INVENTION

1. Field of the Invention

The invention relates to a circuit arrangement for the summation of products formed by analog signals and digital coefficients in which the products are produced with the use of a multiplying digital-analog converter.

2. Description of the Prior Art

Circuit arrangements are already known with the aid of which the sum of products are produced for analog signals and coefficients illustrated in an analog manner and assigned to said products. Such a circuit arrangement, for example, is disclosed in German Auslegeschrift No. 1,157,677 in conjunction with a digital filter. In this known circuit arrangement, analog signals which are emitted at the outputs of transit time elements are multiplied with the aid of potentiometers having analogously adjustable coefficients. The signals relating to the product of the analog signals and the coefficients are fed to a summation stage. The summation stage emits a signal at its output which is proportional to the sum formed by the analog signals and the respectively assigned coefficients. It is also conceivable to employ analog multiplier stages instead of the potentiometers. However, the circuit arrangement operates in both cases without sufficient precision as the coefficients have to be respectively analogously adjusted.

It would also be conceivable to provide digital multiplier stages instead of the analog multiplier stages and to also provide a digital summation stage instead of the analog summation stage. The digital multiplication and summation can be accomplished with great precision, however, such a circuit arrangement would be very expensive. Moreover, analog-digital converters would be required at the outputs of the transit time elements in order to assign digital values to the analog signals.

SUMMARY OF THE INVENTION

It is an object of the present invention to disclose a circuit arrangement for the summation of products formed by analog signals and coefficients assigned to those analog signals. The circuit arrangement is to be inexpensive on one hand, and operate with great precision on the other.

According to the invention, in the circuit arrangement the analog signals are fed to a reference input of the digital-analog converter at successive points of time, digital coefficients assigned to the respective analog signals are fed to the data inputs of the digital-analog converter, and a summation stage is provided which has output signals of the digital-analog converter or transducer fed there which are assigned to the products of the analog signals and the coefficients. The summation stage integrates the digital-analog converter output signals over a respectively predetermined length of time.

The circuit arrangement of the invention has the advantage that it is inexpensive since a large number of products are formed from the analog signals and the corresponding coefficients with the aid of a single multiplying digital-analog converter. The circuit arrangement functions with great precision as the coefficients are present in a digital form and can be adjusted with great precision if a sufficient number of binary signals are present.

An advantageous development of the circuit arrangement is characterized in that a switching stage is provided which respectively connects an analog signal and a coefficient respectively assigned to the digital-analog converter at successive points in time. A summation stage in the circuit arrangement is set in accordance with a respectively predetermined length of time.

In order to respectively connect an analog signal through to the digital-analog converter it is advantageous if a multiplexer is connected in series to the reference input of the digital-analog converter. This multiplexer has signal inputs at which the analog signals connect and has selection inputs which are connected to the switching stage via an address register.

In order to keep the coefficients respectively assigned to the analog signals ready, it is expedient if a coefficient store is provided which contains the coefficients. This store has an address input connected to the addresses given off by the switching stage via an address register. This store also respectively gives off a coefficient to the data inputs of the digital-analog converter depending upon the address.

In case the analog signals are not multiplied with constant coefficients, but rather with variable coefficients, it is advantageous if an adder is connected in series to the coefficient store. A coefficient, on one hand, and a correction value on the other hand, are conveyed to the adder. Outputs of the adder are connected to a write input of the coefficient store.

A particularly advantageous utilization of the circuit arrangement results when signals are provided as analog signals at the reference input of the digital-analog converter. These signals appear at the outputs of delay elements provided as digital filters.

It is particularly advantageous if a digital compensating device is provided as a digital filter.

DESCRIPTION OF THE PREFERRED EMBODIMENTS

Figure 1:
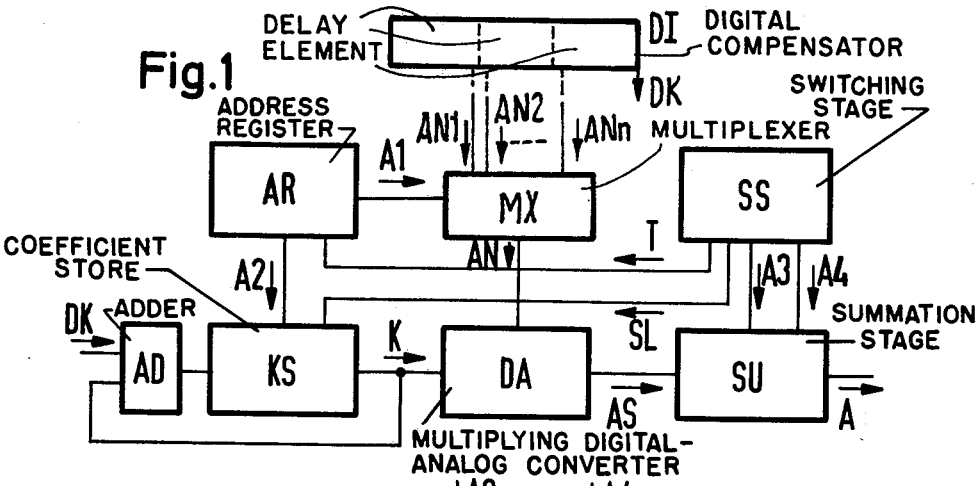
FIG. 1 illustrates a block circuit diagram of the circuit arrangement of the invention.

The circuit arrangement illustrated in FIG. 1 contains a digital-analog converter or transducer DA to whose reference input analog signals AN are conveyed. Digital coefficients K assigned to the analog signals AN are fed to the data inputs of the digital-analog converter DA. These digital coefficients are respectively formed by a multiplicity of binary signals. Output signals AS are present at the output of the digital-analog converter DA. These output signals respectively correspond with the product from an analog signal AN and an associated coefficient K. The output signals AS are summed up in a summation stage SU during a respectively predetermined length of time. The summation stage SU presents output signals A at its output. These output signals are assigned to the sum of the products from the analog signals AN and the associated coefficients K.

The circuit arrangement, furthermore, contains a multiplexer MX to whose data inputs a multiplicity of analog signals AN1 through ANn are conveyed. Selection signals A1 are fed to the selection inputs of the multiplexer MX which respectively connect via one of the analog signals AN1 through ANn to the output of the multiplexer MX at successive points in time. The selection of the corresponding analog signals results with the aid of an address register AR controlled by a switching stage SS. The address register consists of one counter in the simplest case. The counter is stepped up with the aid of timing pulses T emitted by the switching stage SS, and the signals at the outputs of the individual stages of the counter form the selection signals A1 and also address signals A2 conveyed to a coefficient store KS containing the coefficients.

In case the coefficients in the coefficient store KS are to be variable, it is expedient to provide an adder AD to whose first input the signals K, respectively assigned to one coefficient, are conveyed, and to whose second input signals DK are conveyed which are assigned a modification value. The output of the adder AD is connected to a write input of the coefficient store KS. If the switching stage SS sends a signal SL to the coefficient store KS, the presently read out coefficient is replaced by a coefficient modified by the modification value in the coefficient store.

It is assumed for a precise description of the circuit arrangement that the signal A has the value $\phi$ at the output of the summation stage and the signal DK has the value $\phi$ at the input of the adder AD. Moreover, it is assumed that the address $\phi$ is stored in the address register AR. The address register AR controls the multiplexer MX, in this case by means of the signals A1, in such a manner that the analog signals AN1 are connected through to the output and are conveyed to the digital-analog converter DA. Simultaneously, the signals A2 conveyed to the coefficient store KS, which can be identical with the signals A1, together with the signals SL, sent by the switching stage SS, effect a reading of a coefficient K1 from the coefficient store KS. Coefficient K1 belongs to the analog signal AN1. This coefficient K1 is sent to the digital-analog transducer DA by means of the signals K. The digital-analog converter DA sends the signal AS at its output. This signal is assigned to the product from the analog signal AN1 and the corresponding coefficient K1. With the aid of a signal A3 sent by the switching stage SS, the signal AS is added to the assumed initial value $\phi$ in the summation stage SU. Thus, the output signal A corresponds with the store signal AS after the appearance of signal A3. The switching stage SS sends a timing pulse T to the address register AR after the appearance of signal A3, and increases the value of said address register to 1. Therewith the multiplexer MX sends the analog signal AN2 through to the digital-analog converter DA, and simultaneously a coefficient K2, assigned to the analog signal AN2, is read out from the coefficient store KS and conveyed to the data inputs of the digital-analog converter DA. Now the digital-analog transducer DA presents at its output an output signal AS which is assigned to the product from the analog signal AN2 and the associated coefficient K2. With the appearance of an additional signal A3, the instantaneous value of the signal AS is added to the preceding value of signal A already stored in the summation stage SU. At the output of the summation stage SU a signal is now sent which is proportional to the sum of the products of the analog signals AN1 and AN2 multiplied by the respective coefficients K1 or K2, respectively.

This process is repeated until the last analog signal ANn has been multiplied by a coefficient Kn assigned to the analog signal. Then an output signal A is available at the output of the summation stage SU. This output signal is proportional to the sum of the products determined with the aid of the digital-analog converter DA. An additional signal A4 can be conveyed to the summation stage SU from the switching stage SS. This signal resets the summation stage to an initial value, for example to the initial value $\phi$ again, after a respectively prescribed time duration. The prescribed time duration, for example, can be equal to the duration during which all products have been formed once with the aid of the signals AN1 through ANn.

After the resetting of the summation stage SU, the content of the address register AR also assumes the value $\phi$ and the process repeats in such manner that again the analog signals AN1 through ANn are multiplied with the corresponding coefficients K1 through Kn at successive points of time. However, the instantaneous values of the analog signals AN1 through ANn can be different from the instantaneous values in the previously completed process.

The utilization of digital-analog transducers for the multiplication of an analog signal with a coefficient present in digital form is already generally known. For the digital analog converter, for example, a Mono DAC-02 produced by Precision Monolithics, Inc., USA, is commercially available.

Figure 2:
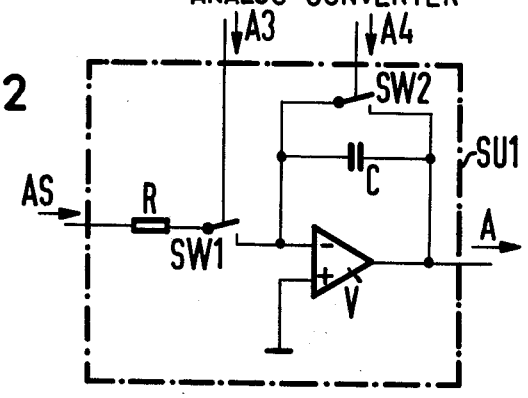
FIG. 2 shows a circuit diagram of a summation stage.

The summation stage SU, illustrated in FIG. 2, is constructed from an integrator and two switches SW1 and SW2. The integrator consists of an operational amplifier V, a resistance R connected in series to the inverting input, and a capacitor C arranged between the output and the inverting input. The output signal AS of the digital-analog converter DA is conveyed to the inverting input of the amplifier V via the resistance R and via the switch SW1 which is to be closed by the signal A3. During the summation, the switch SW2, which is actuated by the signal A4, is opened. At the output of the amplifier V, the output signal A is present which is proportional to the time integral which represents the instantaneous values of the output signals AS which are present when the switch SW1 is closed. After the respectively prescribed duration, the switch SW2 is closed and the capacitor C is discharged with the aid of signal A4. Thus, the summation stage SU is reset to an initial value and the output signal A then has, for example, the value $\phi$.

The circuit arrangement is particularly useful in digital filters in which analog signals are multiplied by various coefficients and are subsequently summed up. Such a digital filter, for example, is a digital compensator as is described in German Auslegeschrift No. 1,157,677. In such a digital compensator DI an input signal to be compensated for is conveyed to several delay elements provided with taps. The signals at the taps of the delay elements are conveyed to the multiplexer MX as signals AN1 through ANn. The coefficients with which said signals are multiplied are stored in the cofficient store KS. The products of the analog signals AN1 through ANn having the respective coefficients are summed up in the summation stage SU and the instantaneous values of the compensated input signal are available at the output of the summation stage SU in accordance with the respectively prescribed durations.

In case the digital compensator DI is constructed as a variable compensator in which the coefficients are not rigid but rather variable, the signal DK is produced with the aid of a control stage at the output of the compensator. This signal respectively indicates the amount by which the coefficient must be altered in order to attain an optimum compensation of the input signal. The new coefficient, given off at the output of the adder AD, is then stored into the coefficient store KS with the aid of a signal SL, provided by the switching stage SS directly after the reading of the corresponding coefficient from the coefficient store KS.

Figure 3:
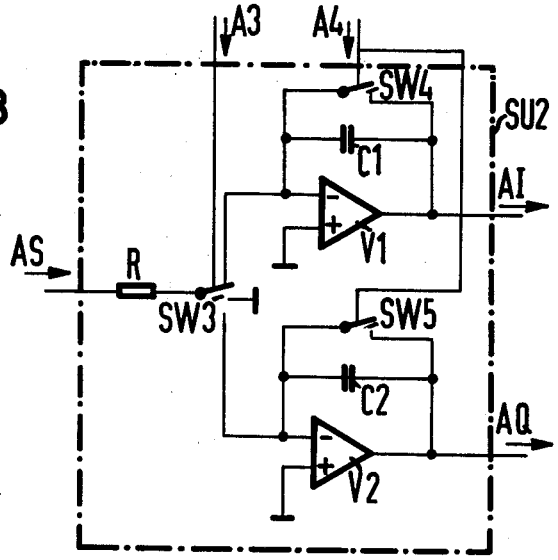
FIG. 3 illustrates a circuit diagram of another summation stage.

The additional summation stage SU2, illustrated in FIG. 3, is provided for a utilization of the circuit arrangement in a two-channel digital compensator. The summation SU2 contains two integrators which are respectively formed of the resistance R, the amplifier V1, and the capacitor C1 or the amplifier V2 and the capacitor C2, respectively. The output signal AS coming from the digital-analog converter DA is alternately conveyed to the amplifier V1 and the amplifier V2 via the resistance R with the aid of the switch SW3 controlled by the signal A3, depending whether the analog signals AN1 through ANn, which are the basis for the output signal AS, are assigned to the first or to the second channel of a two-channel digital compensator. In a similar manner as in the summation stage SU1 illustrated in FIG. 2, the two integrators in the summation stage SU2 are reset with the aid of the signal A4 and the switch SW4 and SW5 to an initial value whenever all analog signals respectively assigned to one channel have been requisitioned once for the production of the products. Output signals AI or AQ are present at the outputs of the two integrators. These output signals have instantaneous values which represent the instantaneous values of the corrected input signals directly before the signals A4 occur.

Although various minor modifications may be suggested by those versed in the art, it should be understood that we wish to employ within the scope of the patent granted hereon all such modifications as reasonably and properly come within the scope of my contribution to the art.

We claim as our invention:

1. A circuit arrangement for a summation of products formed from analog signals and digital coefficients, comprising: a multiplying digital-analog converter means for producing said products; a reference input of the multiplying digital-analog converter means receiving the analog signals at successive points in time; data inputs of the multiplying digital-analog converter means receiving digital coefficients assigned to respective analog signals; a summation means connected to output signals of the multiplying digital-analog converter means corresponding to the products of the analog signals and the digital coefficients; and said summation means integrating said output signals over a respectively predetermined time period.

2. A circuit arrangement in accordance with claim 1, characterized in that a switching means is provided for sending the analog signals and sending corresponding coefficients to the multiplying digital-analog converter means at said successive points in time, said switching means also setting the summation means to an initial value after the respectively predetermined time period.

3. A circuit arrangement in accordance with claim 2, characterized in that a multiplexer means is connected in series to said reference input of the multiplying digital-analog converter means, said multiplexer means having signal inputs to which are connected the analog signals and having selection inputs which are connected to the switching means via an address register means.

4. A circuit arrangement in accordance with claim 2, characterized in that a coefficient storage means is provided containing the digital coefficients and having an address input to which are connected addresses sent by the switching means via an address register, said coefficient storage means sending a respective coefficient to the data inputs of the multiplying digital-analog converter means depending upon the respective address.

5. A circuit arrangement in accordance with claim 4, characterized in that an adder means is connected in series to the coefficient storage means, said adder means receiving at its inputs a respective coefficient from an output of the coefficient store and a respective correction value from a variable compensator, and said adder means having an output connected to a write input of the coefficient storage means.

6. A circuit arrangement in accordance with claim 1, characterized in that the analog signals connected to the reference input of the multiplying digital-analog converter means are formed at outputs of delay elements in a digital filter.

7. A circuit arrangement in accordance with claim 6, characterized in that said digital filter is provided as a digital compensator.

8. A circuit arrangement for a summation of products from analog signals and digital coefficients, comprising:

(a) a source of analog signals;
(b) a source of digital coefficients;
(c) timing means for supplying respective analog signals and corresponding respective digital coefficients at successive points in time;
(d) a multiplying digital-analog converter means having a reference input connected to receive the respective analog signals and having a data input for receiving the respective digital coefficients, an output of the multiplying digital-analog converter means providing output signals corresponding to respective products of the respective analog signals and digital coefficients; and
(e) summation means for integrating said output signals over a predetermined time period.

* * * * *